US006925396B2

(12) United States Patent
Remington

(10) Patent No.: US 6,925,396 B2
(45) Date of Patent: Aug. 2, 2005

(54) METHOD AND APPARATUS FOR MEASURING ENERGY USAGE IN A PRESS MACHINE

(75) Inventor: John Remington, Celina, OH (US)

(73) Assignee: The Minster Machine Company, Minster, OH (US)

( * ) Notice: Subject to any disclaimer, the term of this patent is extended or adjusted under 35 U.S.C. 154(b) by 0 days.

(21) Appl. No.: 10/250,164

(22) Filed: Jun. 9, 2003

(65) Prior Publication Data

US 2004/0249581 A1 Dec. 9, 2004

(51) Int. Cl.[7] ..... B30B 15/26
(52) U.S. Cl. ..... 702/44; 702/33; 702/105; 72/21.3
(58) Field of Search ..... 702/33, 41, 44, 702/105, 113, 114, 145, 148; 700/170, 206; 100/305, 315, 316; 72/21.3, 21.4, 21.5

(56) References Cited

U.S. PATENT DOCUMENTS 6,053,099 A * 4/2000 Gruber ..... 100/35
6,654,661 B2 * 11/2003 Schmitz ..... 700/206

* cited by examiner

*Primary Examiner*—Bryan Bui
(74) *Attorney, Agent, or Firm*—Randall J. Knuth

(57) ABSTRACT

An instrument system for a press machine environment includes a monitoring apparatus to determine the flywheel speed, slide speed, and slide displacement relative to, for example, Top Dead Center. These measurements are used to determine the energy consumed by the slide as a function of slide displacement as its travels during its work stroke. A piston-cylinder combination is disposed at a die location to emulate a die set and to facilitate a determination of the load developed by the slide as it actuates movement of the piston. A computation of the work produced by the slide during piston movement can be determined on the basis of measurements of piston displacement and slide-induced pressure applied to the piston. A display plots various graphs to depict slide energy, slide work, and flywheel speed as a function of slide displacement.

41 Claims, 4 Drawing Sheets

METHOD AND APPARATUS FOR MEASURING ENERGY USAGE IN A PRESS MACHINE

BACKGROUND OF INVENTION

1. Field of the Invention

The present invention relates to a press machine environment, and, more particularly, to a method and apparatus for measuring and evaluating energy consumption and work production, specifically as a function of slide displacement during the work stroke of a press machine operating cycle.

2. Description of the Related Art

Mechanical presses of the type performing stamping and drawing operations employ a conventional construction having a movable slide guided by a frame structure including a crown and a bed. The frame structure supports the slide in a manner enabling reciprocating movement of the slide towards and away from the bed. The slide is driven by a crankshaft using a connecting arm assembly coupled to the slide. Press machines are widely used for a variety of workpiece operations and employ a large selection of die sets. Accordingly, press machines vary considerably in size and available tonnage depending upon its intended use.

A flywheel and clutch assembly are utilized to transmit mechanical energy from a main drive motor to the press-crankshaft. The flywheel assembly serves as the primary source of stored mechanical energy and rotary driving power. Standard press configurations have the flywheel located between the main drive motor and clutch, with the flywheel being mounted on either the driveshaft, crankshaft or press frame by use of a quill.

The main drive motor replenishes the flywheel with rotational energy as it becomes depleted during the course of press working strokes, namely, as the clutch engages the flywheel and establishes a driving connection between the flywheel and the crankshaft. In particular, when the crankshaft and flywheel are engaged in driving relationship, the flywheel energy is converted into mechanical work to power the press components, namely, the reciprocating slide. During engagement of the clutch, the flywheel drops in speed as the press driven parts are brought up to running speed. Press machine performance typically is described in terms of tonnage, which refers to the load developed by the press machine. However, for purposes of determining the efficiency of press machine operation, tonnage reveals nothing more than the compressive force applied to the die workpiece and therefore provides no indication as to the proportion of actual energy converted into usable work. There is needed an improved metric for describing energy consumption that better reflects the energy yield, namely, the efficiency of transferring energy from the flywheel to work in the form of workpiece processing activity.

In particular, according to the invention, machine efficiency may be investigated by determining the amount of available energy that is converted into actual useful work, e.g., die processing. During press operation, energy is extracted from the flywheel to drive the slide and develop a corresponding tonnage or load that is applied to the workpiece. Accordingly, a comparison can be made between the energy generated by the flywheel and the amount of energy applied to the workpiece as die processing (e.g., work). During the working stroke, the flywheel experiences a gradual decrease in speed as the slide gains speed while it advances towards its machining engagement with the workpiece.

SUMMARY OF INVENTION

According to the present invention there is provided an instrument system for a press machine environment. The instrument system includes a monitoring apparatus to determine flywheel speed, slide speed, and slide displacement relative to Top Dead Center. These measurements are used to determine the energy consumed by the slide as a function of slide displacement, particularly as the slide travels during its work stroke, although the energy calculation can be made in reference to any other part of the press cycle.

A piston-cylinder combination is disposed at a die location to emulate a die set and to facilitate a determination of the load developed by the slide as it actuates movement of the piston. A computation of the work produced by the slide during piston movement can be determined on the basis of measurements of piston displacement and slide-induced pressure applied to the piston. A display plots various graphs to depict slide energy, slide work, and flywheel speed as a function of slide displacement.

The invention, in one form thereof, is directed to a system for use with a press machine having a slide, a flywheel operatively connected to the slide, and a die location. The system includes, in combination, a first means to provide an indication of slide location; a second means to provide a measure of slide energy and/or slide work; and a third means to provide an indication of the slide energy and/or work measurement relative to the slide location indication.

The system further includes a sensor to provide a measure of flywheel speed, and an apparatus to provide an indication of the flywheel speed measurement relative to the slide location indication. A means provides a comparison between the slide energy measurement and the flywheel speed measurement. The system further includes a means to provide a measure of flywheel energy; and a means to provide a comparison between the slide energy and/or work measurement and the flywheel energy measurement.

In one form, the second means further includes an apparatus to determine a speed value for the slide; and an apparatus to determine a value representative of slide kinetic energy, using the slide speed value. The second means further includes an apparatus to provide a measure of load operatively developed by the slide.

In one form, this apparatus includes a piston-cylinder combination disposed proximate the die location, wherein the piston of the piston-cylinder combination being suitably arranged to enable operative engagement with the slide. A device is disposed in operative communication with the piston-cylinder combination, the device being configured to provide a measure of force and/or pressure operatively applied to the piston of the piston-cylinder combination.

The system preferably is operative during at least part of a work portion of a press machine cycle.

The invention, in another form thereof, is directed to a system for use with a press machine. The system includes, in combination, a first assembly configured to operatively provide an indication of slide-related energy and/or slide-related work, and an output device operatively connected to the first assembly.

The first assembly is configured further to provide the indication of slide-related energy and/or work in relation to slide location. The first assembly further includes an apparatus to provide a measure of load operatively developed by the slide, comprising a piston-cylinder combination disposed proximate the die location, wherein the piston of the piston-cylinder combination being suitably arranged to enable operative engagement with the slide; and a device disposed in operative communication with the piston-cylinder combination, the device being configured to provide a measure of force and/or pressure operatively applied to the piston of the piston-cylinder combination.

The invention, in another form thereof, is directed to a method for use with a press machine. The method involves running the press machine, and then determining slide energy and/or slide work as a function of at least one selectable parameter. The at least one selectable parameter includes at least one of slide location, slide displacement relative to Top Dead Center, press cycle position, flywheel speed, and flywheel energy.

In one form, the slide energy and/or work determination step further includes the steps of providing a measure of slide kinetic energy and/or providing a measure of load developed by the slide.

In one form, the step of providing the load measurement further includes the steps of causing the slide to engage a piston of a piston-cylinder combination, and determining force and/or pressure applied to the piston of the piston-cylinder combination.

In another form, the method further includes the step of comparing the determination of slide energy and/or work with a determination pertaining to flywheel speed and/or flywheel energy.

The invention, in another form thereof, is directed to a method for use with a press machine. The method involves determining slide energy and/or slide work, and then outputting at an output device the determination of slide energy and/or work.

In one form, the slide energy and/or work determination step further includes the step of determining slide kinetic energy and/or slide-load as a function of slide location. A further method step involves comparing the determination of slide energy and/or work with an indication of flywheel speed and/or flywheel energy.

The invention, in another form thereof, is directed to a method for use with a press machine. The method involves determining slide location; determining a value of slide energy and/or slide work; and providing a comparison between the value of slide energy and/or slide work and the determination of slide location.

In one form, the method further involves determining flywheel speed and/or flywheel energy, and then comparing the determination of slide energy and/or slide work with the determination pertaining to flywheel speed and/or flywheel energy.

One advantage of the present invention is that the energy calculations pertaining to slide activity and flywheel activity provide a more meaningful metric for measuring and determining the efficiency and performance of the press machine.

Another advantage of the present invention is that the instrument system enables a user to determine and display actual energy consumed over an arbitrary linear dimension (i.e., inch-tons) and to correlate, associate, or otherwise coordinate this energy consumption with a measurement of flywheel slowdown occurring during the same interval of linear travel (e.g., slide displacement).

A further advantage of the invention is that the piston-cylinder combination successfully emulates a die set so that accurate measurements and computations can be obtained concerning the slide-induced load and the work performed by the slide while actuating the piston.

BRIEF DESCRIPTION OF DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION

Figure 1:
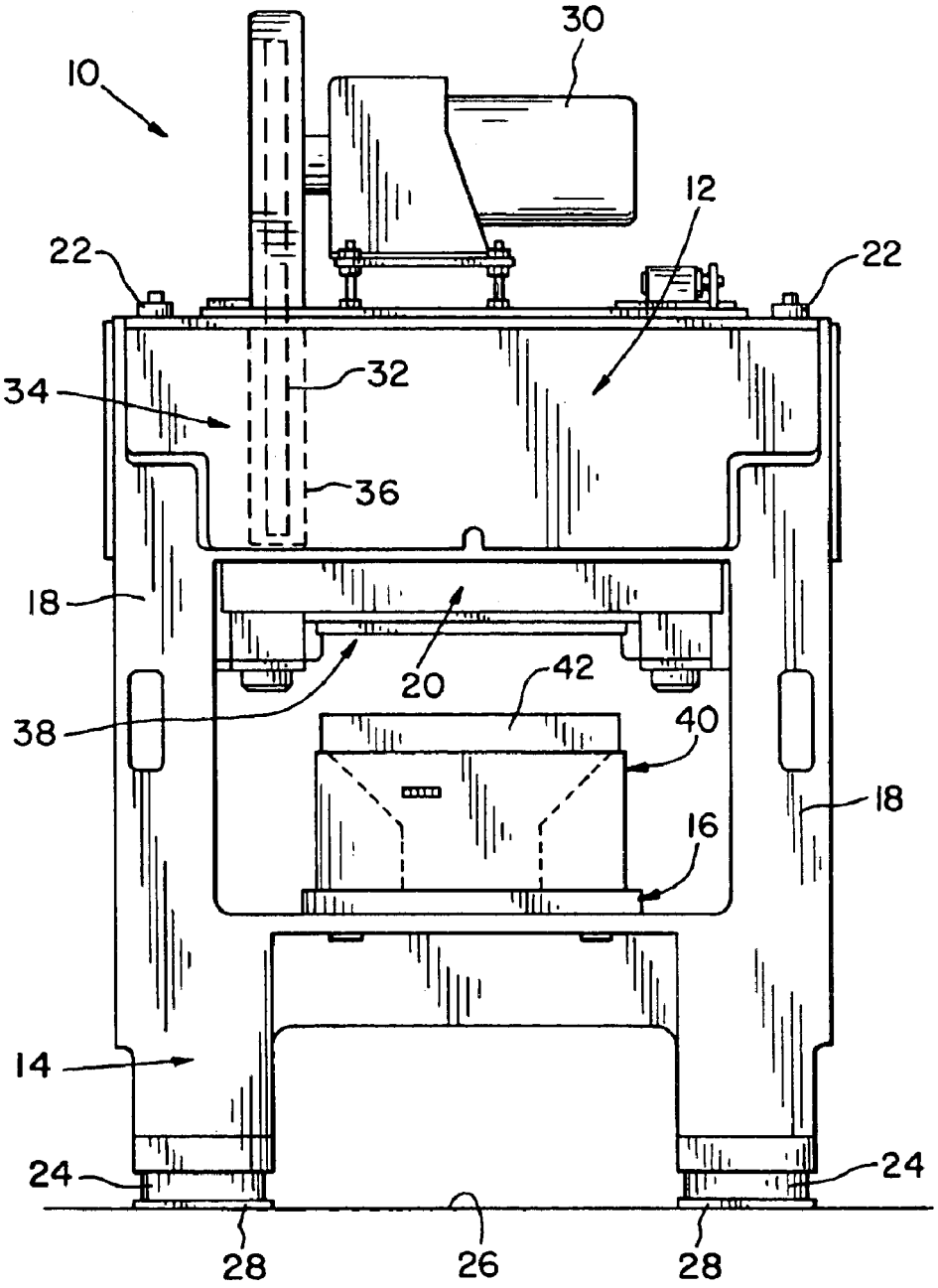
FIG. 1 is a schematic view of a press machine environment for use in practicing the invention.

By way of background, reference is first made to FIG. 1 to illustrate one form of a press machine for use with the invention. More particularly, mechanical press 10 comprises a crown 12 and bed 14 having a bolster assembly 16 connected thereto with uprights 18 connecting crown 12 with bed 14. Uprights 18 are connected to or integral with the underside of crown 12 and the upper side of bed 14. A slide 20 is positioned between uprights 18 for reciprocating movement toward and away from bed 14. A set of tie rods (not shown) extend through crown 12, uprights 18, and bed 14, and are attached at each end with tie rod nuts 22. Leg members 24 are formed as an extension of bed 14 and are generally mounted on shop floor 26 by means of shock absorbing pads 28.

A press drive motor 30 is attached by means of belt 32 to auxiliary flywheel 34. Auxiliary flywheel 34 is connected by means of a belt (not shown) to the main flywheel depicted generally at 36. The flywheel/clutch/brake assembly is depicted generally at 36 with the main flywheel being operative to transmit rotational motion to a crankshaft (not shown). The crankshaft is connected to slide 20 by way of connecting rods (not shown). The crankshaft is operatively connected to the connecting rods so that the rotary motion of the crankshaft is translated into reciprocating movement of slide 20.

A die set includes a die member 38 disposed at a free end of slide 20 and a die member 40 disposed at the upper end of bolster 16. A workpiece 42 is disposed at the upper side of die member 40. As slide 20 travels downwardly during its work stroke, die member 38 eventually engages workpiece 42 and processes workpiece 42 in cooperation with die member 40.

The form of the press machine shown in FIG. 1 is provided for illustrative purposes only, and should not be considered in limitation of the present invention, as it should be apparent to those skilled in the art that the principles of the present invention may be practiced with, and incorporated into, various other machine configurations, including machine environments other than press applications.

The drive apparatus of a press machine typically includes a drive motor directly engaged to rotate a massive flywheel.

The flywheel serves as the source of rotational energy that is appropriately distributed throughout the machine. A clutch assembly selectively connects the flywheel to the crankshaft during a press working stroke. Energy is removed from the flywheel and transferred to the rotating parts of the press, namely, the crankshaft. The crankshaft rotation controls the reciprocating motion of the slide. The linear driving force produced by motion of the slide is used to process a workpiece disposed between respective die shoes attached to the slide and bolster assembly. During operation, then, the rotational energy of the flywheel is used to drive the rotating parts of the machine and produce the stamped part.

By way of further overview, the invention pertains to an investigation of the various mechanisms and types of energy transfer, energy consumption, and energy expenditure evident during the operational cycle of a press machine application. In particular, the invention provides an instrumentation facility that measures and examines the transfer of energy from the flywheel to the slide, specifically with a view towards determining the amount of available energy that is actually converted into useful work, namely, the processing of a die workpiece. The measurements and calculations are particularly useful in connection with the working stroke of the press machine operational cycle.

As known, rotational energy is extracted from the flywheel and transformed into a linear-directed energy component for use in reciprocating the slide. Thus, the flywheel energy is converted into kinetic energy of the slide. As the slide proceeds through the work stroke in the press cycle, the slide typically increases its speed as it approaches the point of impact with the workpiece. This increase in slide speed is made possible by extracting additional energy from the flywheel to facilitate the increased kinetic energy of the slide. As a result, the flywheel typically experiences a corresponding reduction in speed (e.g., revolutions per minute) during the press working stroke.

At a certain point in slide travel during the working stroke of the press cycle, the die mounted to the free end of the slide engages with an opposing complementary die mounted to the bed or bolster and thereby processes a workpiece disposed between the die set. During this die processing period, the kinetic energy of the slide is transferred into usable work, namely, the physical reconfiguration or formation of the workpiece.

At a micro-structural level, this usable work corresponds to the composite summation of all of the individual work components generated during slide contact or engagement, i.e., slide impact and follow-through. In particular, each work component ($W=F*d$) is represented by a force component multiplied by a distance component that defines the amount of material displacement caused by the associated force, such as the deformation produced by the slide impact force.

The slide force applied to the workpiece typically is known as the press tonnage or load and corresponds to the compressive force imparted to the workpiece, such as during a stamping operation. In other machine applications, the load or tonnage may refer to a tensile force experienced by a workpiece, such as during a drawing operation.

The invention provides a facility to measure the various energy components present in a machine environment, particularly during a work stroke. For example, as discussed further, the invention provides a measure of flywheel energy, slide energy (e.g., kinetic energy), slide work (i.e., the work done by the slide in processing a workpiece), and slide-induced load (e.g., the compressive force generated by slide contact with the workpiece). Other measurements include flywheel speed (e.g., in terms of RPM) and slide speed.

Moreover, the invention may provide these measurements as a of any selectable press machine parameter. For example, the measurements can be correlated with slide travel expressed as a linear displacement of the slide relative to the Top Dead Center (TDC) position of the slide. In this manner, for example, it is possible to depict the variations in flywheel energy and slide energy as a function of slide displacement, which itself is representative of a point in the work stroke. Alternately, the measurements can be correlated to other representations of slide travel, such as angular position during the press cycle when the press cycle is depicted in polar coordinates rather than Cartesian coordinates.

In one specific form, the invention would furnish various calculations that include, but are not limited to, the overall energy generated by the flywheel, the overall energy consumed by the slide in the form of kinetic energy, and the work produced by the slide (i.e., energy expenditure). Alternately, intermediate calculations can be made to determine such energy values over any selectable slide path, i.e., selectable distance of slide travel. The calculation and computations discussed herein can be provided as instantaneous values, cumulative values (e.g., running totals), average values, or any other suitable form known to those skilled in the art.

In other forms, the invention will provide a comparative view of the various measurements and calculations. For example, the energy transfer mechanism involving the flywheel and slide can be depicted in a graph that plots both flywheel energy and slide energy as a function of slide displacement. The flywheel energy can be represented by an absolute speed value (e.g., RPM) or a relative speed value (e.g., percent slowdown from top running speed).

Alternately, the cooperative interaction between the flywheel and slide can be depicted by a graph that plots slide energy in relation to flywheel speed.

Additionally, the transition that occurs during workpiece processing as the slide kinetic energy is converted into a compressive load applied to the workpiece (i.e., work) can be depicted in a graph that plots both slide energy and slide-induced work as a function of slide As discussed further, the invention provides a means to measure the load developed by the slide. A piston-cylinder combination is disposed in the die location such that a free end of the piston is arranged for contact by the slide at the same point in slide travel as the die workpiece would otherwise be contacted. The piston-cylinder combination emulates a die set to facilitate a determination of the compressive force imparted by the slide. A device measures the force applied by the slide to the piston to thereby enable computation of the load developed by the slide. The device can also measure the piston displacement so that the measured force and piston displacement values can be used to obtain a computation of the work produced by the slide.

Figure 2:
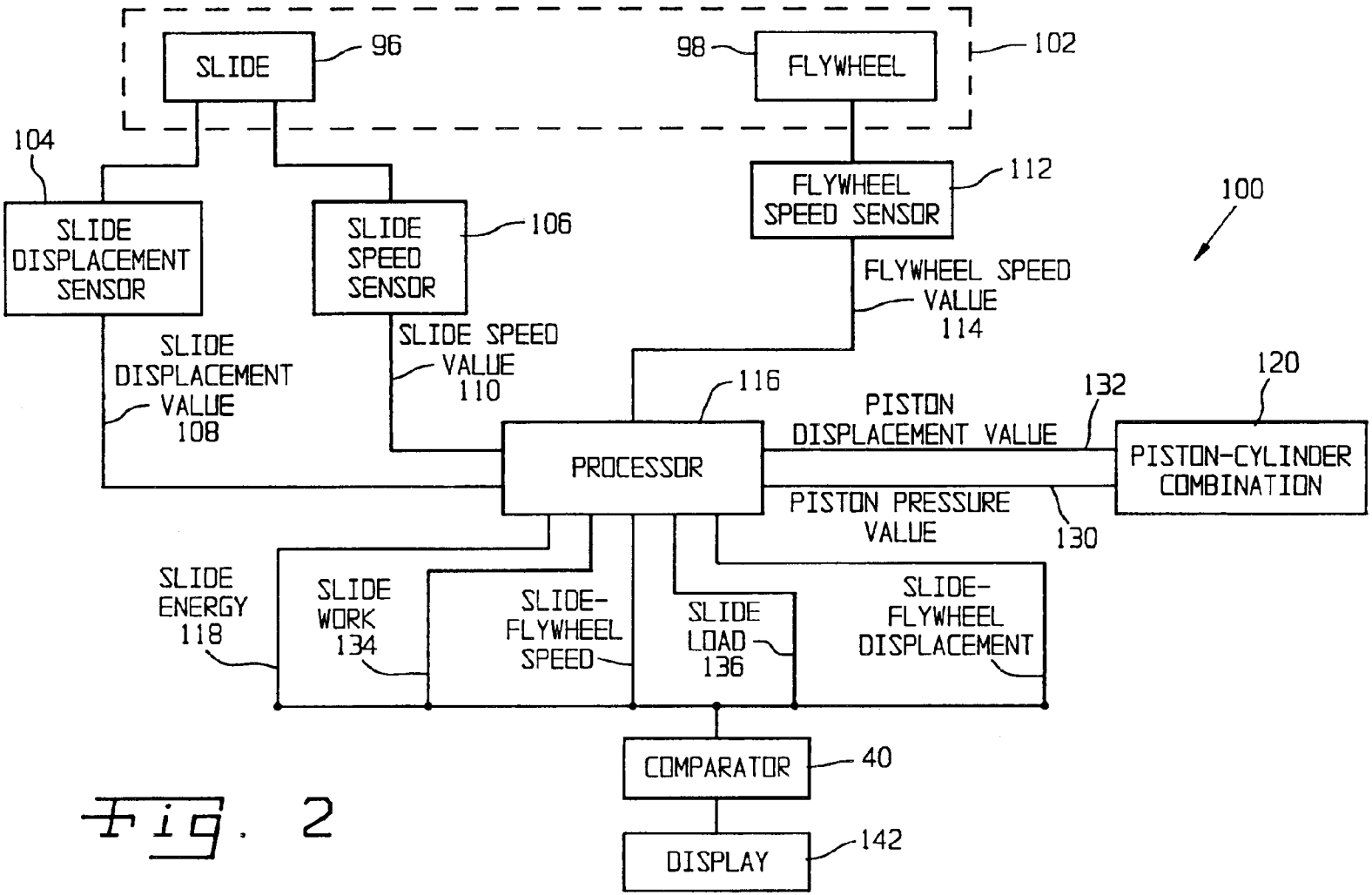
FIG. 2 is a block diagram view of an instrument system, according to the invention.

Referring now to FIG. 2, there is shown an illustrative block diagram schematic view of an instrument system 100 for use in conjunction with a representative press machine environment 102, according to one form of the invention.

The illustrated system 100 includes a first slide-related instrument apparatus comprising a slide displacement sensor 104 and a slide speed sensor 106. Sensor 104 provides a slide displacement value 108 representative of the location of the slide 96. In various forms, the slide location may be provided as an absolute value (e.g., press cycle positional coordinate) or as a slide position relative to a reference mark, such as displacement relative to TDC. Sensor 106 provides a slide speed value 110 representative of the speed of the slide.

The illustrated system 100 includes a second flywheel-related instrument apparatus comprising a flywheel speed sensor 112. Sensor 112 provides a flywheel speed value 114 representative of the speed of flywheel 98, e.g., the rotational or angular velocity expressed in RPMs.

Sensors 104, 106 and 112 may be of any conventional form, such as transducer-type devices capable of obtaining the respective sensor readings using a non-contact or contact-type interface with the slide. The sensors can provide any type of programmable data monitoring, such as continuous or intermittent (e.g., selectively periodic) readings. Any method known to those skilled in the art may be used to configure the press machine environment with such suitable sensors.

The illustrated instrument system 100 further includes a processor 116 arranged to receive the respective output signals 108, 110 and 114 from sensors 104, 106 and 112. Processor 116 includes various data computation and calculation functions.

For example, processor 116 can utilize slide speed value 110 to compute the kinetic energy of slide 96 according to the equation K.E.=Â½*m*$v^2$, where "m"equals the mass of the slide and "v"equals the velocity of the slide. A computation of the potential energy of slide 96 can be made according to the equation P.E.=m*g*h, where "m" equals the mass of the slide, "g" equals the gravitational constant, and "h" refers to the distance between the slide and die location (as determined from slide displacement value 108).

Processor 116 can be programmed to provide the slide energy computations in any format, such as instantaneously or over any selected interval. For example, processor 116 can furnish the total energy consumed or expended by slide 96 during its working stroke or in reference to any subpart of the working stroke or press cycle.

According to one form of the invention, instrument system 100 is provided with a piston-cylinder combination 120 operatively disposed at the die location of the press machine. For example, the piston-cylinder combination 120 may be located at the upper side of the bed or bolster where a die member and associated workpiece would otherwise be configured in an actual press machine application.

The piston-cylinder combination 120 is suitably arranged such that the piston is substantially aligned with the direction of slide travel. Moreover, the piston is suitably arranged such that one end is normally or selectively positioned to enable the slide to axially impact the piston and cause (i.e., actuate) displacement of the piston relative to the cylinder. In a preferred form, the piston-cylinder configuration would allow the slide to engage the piston precisely at the same point in the slide travel as the die-workpiece combination would otherwise experience contact during a processing operation.

The piston-cylinder combination 120 may be provided with an adjustment mechanism enabling it to be positioned at other vertical elevations such that the piston is contacted at different slide travel displacements. Any form of piston-cylinder arrangement can be used, such as hydraulic.

The piston-cylinder combination 120 effectively emulates the loading conditions experienced by an actual die set. This emulation feature enables the piston-cylinder combination 120 to be used to determine various die-related and workpiece-related parameters, such as the compressive force applied by the slide and the linear duration of the force. Both of these parameters can be determined using appropriate devices to measure piston displacement and pressure applied to the piston, as discussed below.

Figure 3:
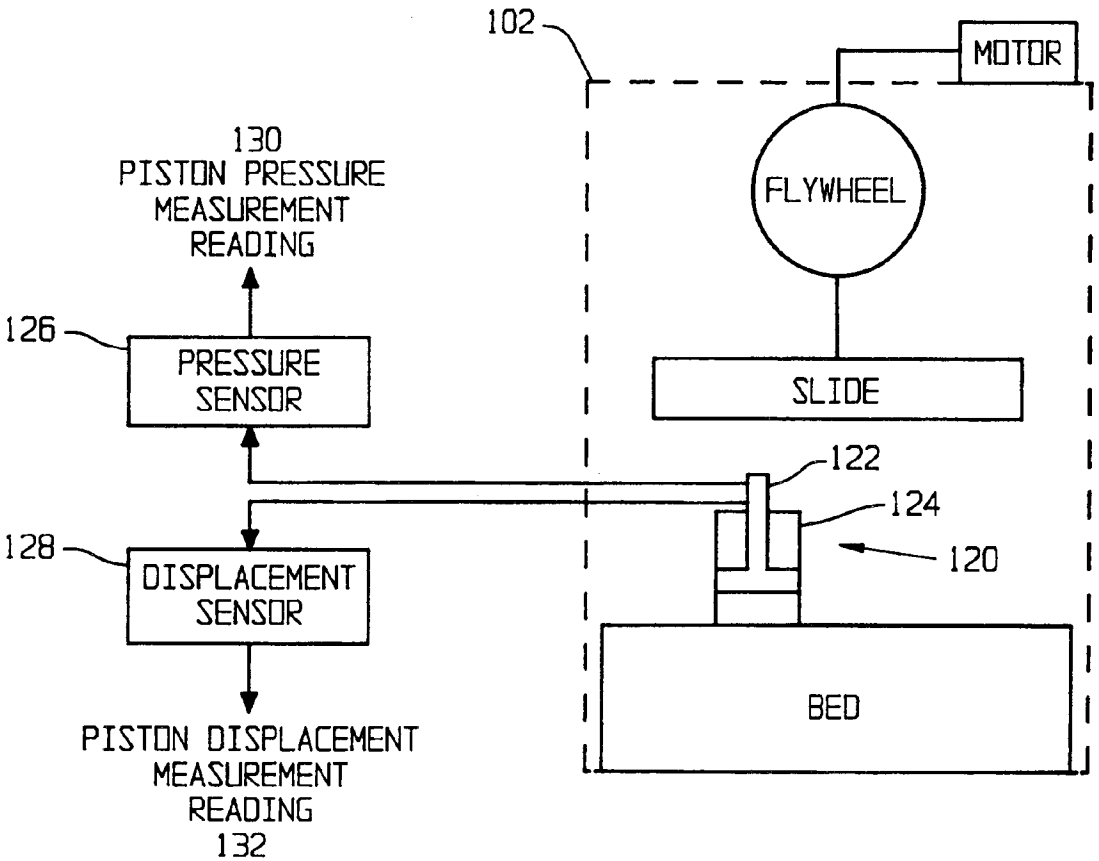
FIG. 3 is a block diagram schematic view of a die emulation assembly employing a piston-cylinder combination, according to the invention.

Referring briefly to FIG. 3, there is shown a partial schematic, partial block diagram view of a piston-cylinder combination 120, according to one form of the invention. The illustrated piston-cylinder combination 120 includes a piston. 122 and cylinder 124 in conventional arrangement. In this form, piston 122 is movable relative to stationary cylinder 124 mounted to the press bed. Alternately, piston-cylinder combination 120 can be provided in a different form where the cylinder is movable relative to a stationary piston. In this form, the cylinder would be disposed for impact-type engagement by the press slide and be the subject of the speed and displacement measurements.

The illustrated piston-cylinder combination 120 is configured with a monitoring apparatus comprising a pressure sensor 126 and a displacement sensor 128. These sensors may be provided in any suitable conventional form. Pressure sensor 126 generates a piston pressure measurement reading 130 representative of the pressure or compressive force that is being applied to piston 122 as the press slide engages it. This pressure reading 126 is indicative of the tonnage or load being developed by the press slide. Displacement sensor 128 generates a piston displacement measurement reading 132 representative of the amount of linear movement (i.e., displacement) experienced by piston 122 in response to the loading conditions.

Returning now to FIG. 2, processor 116 receives the piston displacement value 132 and piston pressure value 130 (FIG. 3) and computes a slide work calculation 134 and slide load calculation 136. In particular, the slide load calculation 136 is based upon the piston pressure value 130. The slide work calculation 134 uses the piston displacement value 132 and piston pressure value 130 to determine the work performed by the slide as it engages and moves the piston of piston-cylinder combination 120. The slide work calculation 134, in particular, is obtained according to the work equation W=F*d, where "F"equals the force delivered to the piston (indicated by piston pressure value 130) and "d"equals the distance traveled by the piston under the influence of the slide-related force (indicated by piston displacement value 132).

Processor 116 can also provide data signals indicating slide and/or flywheel speed and displacement, based upon slide speed value 110, flywheel speed value 114, and slide displacement value 108.

Processor 116 includes a control and data management function capable of correlating the various measurements, calculations, computations, and other data determinations with the slide location (as indicated by slide displacement value 108). In particular, the slide energy value 118, slide work value 134, and slide load value 136 generated by processor 116 preferably are provided as a function of slide position relative to TDC.

The illustrated instrument system 100 further includes a comparator 140 for use in evaluating, analyzing, and comparing the data generated by processor 116. Notable features of processor 116 and comparator 140 include the ability to provide data indicating the amount of energy consumed by the slide in its travel, the amount of work expended by slide in actuating movement of the piston, and the amount of energy made available by the flywheel. In one form, the comparator outputs are made available for viewing on display 142.

Figure 4:
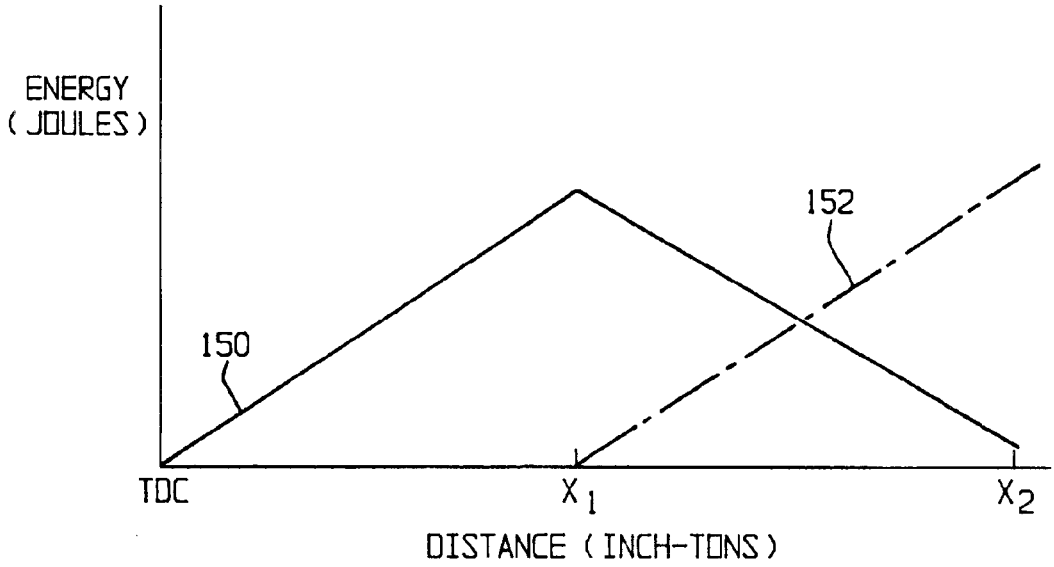
FIG. 4 is a graphical plot illustratively depicting slide energy and slide work as a function of slide displacement.

In one form, comparator 140 may generate a graphical comparison of the slide energy function (indicated by signal 118) and the slide work function (indicated by signal 134), on the basis of slide displacement. For example, in reference to FIG. 4, curve 150 represents the energy of the slide beginning at a reference point (TDC), progressing to maximum energy at the point of contact with the piston (position $x_1$), and declining to a terminal point (position $x_2$) at the end of the slide path as the slide energy is transferred into work in moving the piston. In particular, curve 152 represents the work expended by the slide in actuating movement of the piston.

Figure 5:
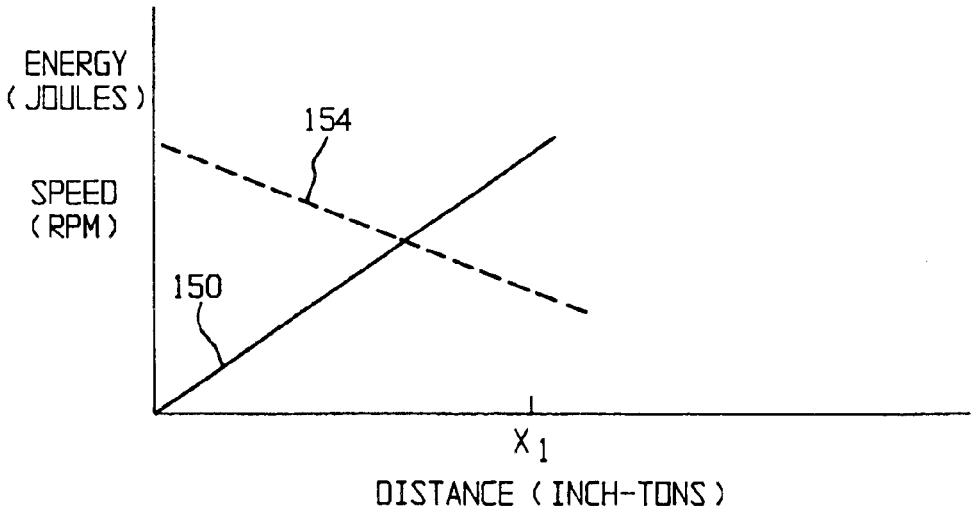
FIG. 5 is a graphical plot illustratively depicting slide energy and flywheel speed as a function of slide displacement.

Comparator 140 of FIG. 2 may also generate a graphical comparison of the slide energy function (indicated by signal 118) and the flywheel speed function, on the basis of slide displacement. For example, in reference to FIG. 5, curve 150 represents the slide energy function (FIG. 4), while curve 154 represents the angular velocity of the flywheel. As shown, as the slide increases its kinetic energy by gaining speed, this energy increase is accommodated by withdrawing energy from the flywheel, as indicated by the decrease in flywheel speed. The flywheel speed can be indicated in absolute terms or in relative terms, namely, as a percentage of top running speed or percentage slowdown.

Although curves 150, 152, and 154 are indicated as linear functions, this depiction is for illustrative purposes only and should not be considered in limitation of the present invention, as it should be apparent that the invention encompasses any other functional representations of the work, energy and speed curves, as known to those skilled in the art.

Processor 116 can perform various efficiency calculations that determine the proportional amount of energy generated by the flywheel that actually performs useful work. In this manner, the amount of consumed energy and wasted energy can be determined. This efficiency computation can be based upon the flywheel energy, slide energy, and slide work values generated by processor 116.

Processor 116 may also be programmed to compute flywheel speed, based upon flywheel speed value 114. For example, the flywheel kinetic energy can be determined according to the equation K=Â½*|*Î€$^2$, where "I"equals the rotational moment of inertia of the flywheel and "Î€"equals the angular speed of the flywheel. The flywheel energy measurements can be used by comparator 140 to generate graphical comparisons with slide energy and slide work, in a manner similar to the formation of the plots in FIGS. 4 and 5.

In one form, instrument system 100 may be configured as a portable device capable of being readily adapted and interfaced with the press machine environment. In another form, the instrument system 100 is segregated into a fixed sensor apparatus and a mobile computational device. For example, the press machine may include an installed set of sensors that can be readily interfaced with a mobile data processing facility having computational, analysis, evaluation, and display capabilities.

It should be apparent that any means may be used to monitor and determine the energy, work, and load values pertaining to the slide and flywheel activity. Moreover, any type of means may be used to determine the speed and displacement values discussed herein. For example, a single sensor can be used to determine displacement, while the speed value can be derived from the displacement function using well-known mathematical techniques, i.e., a differential calculation (v(t)=dx(t)/dt). Alternately, a single sensor can be used to determine the speed, while the displacement value can be derived from the speed function using well-known mathematical techniques, i.e., an integral calculation (v(t)=Î□x(t)dt).

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A system for use with a press machine, said press machine having a slide, a flywheel operatively connected to said slide, and a die location, said system comprising:

a first means to provide an indication of slide location;

a second means to provide a measure of slide energy and/or slide work; and a third means to provide an indication of the slide energy and/or work measurement relative to the slide location indication.

2. The system as recited in claim 1, further includes:

a sensor to provide a measure of flywheel speed; and an apparatus to provide an indication of the flywheel speed measurement relative to the slide location indication.

3. The system as recited in claim 2, further includes:

a means to provide a comparison between the slide energy measurement and the flywheel speed measurement.

4. The system as recited in claim 1, further includes:

a means to provide a measure of flywheel energy; and a means to provide a comparison between the slide energy and/or work measurement and the flywheel energy measurement.

5. The system as recited in claim 1, wherein said second means further includes:

an apparatus to determine a speed value for said slide; and an apparatus to determine a value representative of slide kinetic energy, using the slide speed value.

6. The system as recited in claim 1, wherein said second means further includes:

an apparatus to provide a measure of load operatively developed by said slide.

7. The system as recited in claim 6, wherein said apparatus further includes:

a piston-cylinder combination disposed proximate said die location, wherein the piston of said piston-cylinder combination being suitably arranged to enable operative engagement with said slide; and a device disposed in operative communication with said piston-cylinder combination, said device being configured to provide a measure of force and/or pressure operatively applied to the piston of said piston-cylinder combination.

8. The system as recited in claim 1, wherein said system being operative during at least part of a work portion of a press machine cycle.

9. The system as recited in claim 1, wherein the slide location indication provided by said first means being indicative of slide displacement relative to a reference point.

10. The system as recited in claim 1, wherein said second means also to provide the slide energy and/or work measurement as an instantaneous value and/or a cumulative value.

11. The system as recited in claim 10, wherein the slide energy and/or work measurement being determined in relation to at least part of a work portion of a press machine cycle.

12. The system as recited in claim 1, further includes:

a means to provide a measure of flywheel energy as an instantaneous value and/or a cumulative value.

13. A system for use with a press machine, said press machine having a slide, a flywheel operatively connected to said slide, and a die location, said system comprising:

a first assembly configured to operatively provide an indication of slide-related energy and/or slide-related work; and an output device operatively connected to said first assembly.

14. The system as recited in claim 13, wherein said first assembly being configured further to provide the indication of slide-related energy and/or work in relation to slide location.

15. The system as recited in claim 13, further comprises:

a second assembly configured to operatively provide an indication of absolute value and/or change in value of flywheel speed and/or flywheel-related energy.

16. The system as recited in claim 15, further comprises:

a comparator operatively coupled to said first assembly and said second assembly, said comparator being configured to render a comparison between the indication of slide-related energy and/or work and the indication pertaining to flywheel speed and/or flywheel-related energy.

17. The system as recited in claim 15, wherein said second assembly being configured further to provide the indication of flywheel speed and/or flywheel-related energy in relation to slide location.

18. The system as recited in claim 15, wherein said second assembly being configured further to provide the indication of flywheel-related energy as an instantaneous value and/or a cumulative value.

19. The system as recited in claim 13, wherein said first assembly further includes:

an apparatus to provide a measure of load operatively developed by said slide.

20. The system as recited in claim 19, wherein said apparatus further includes:

a piston-cylinder combination disposed proximate said die location, wherein the piston of said piston-cylinder combination being suitably arranged to enable operative engagement with said slide; and a device disposed in operative communication with said piston-cylinder combination, said device being configured to provide a measure of force and/or pressure operatively applied to the piston of said piston-cylinder combination.

21. The system as recited in claim 13, wherein said first assembly further includes:

a means to determine slide energy and/or slide work; and a means to determine whether the determination of slide energy and/or work pertains to a press load condition or a no-load press condition and to provide a signal indicative thereof.

22. The system as recited in claim 13, wherein said first assembly being configured further to provide the indication of slide-related energy and/or work as an instantaneous value and/or a cumulative value.

23. The system as recited in claim 22, wherein the cumulative value pertaining to the indication of slide-related energy and/or work being defined in relation to at least part of a work portion of a press machine cycle.

24. A method for use with a press machine, said press machine having a slide, a flywheel operatively connected to said slide, and a die location, said method comprising the steps of:

running said press machine; and determining slide energy and/or slide work as a function of at least one selectable parameter.

25. The method as recited in claim 24, wherein said at least one selectable parameter includes at least one of slide location, slide displacement relative to Top Dead Center, press cycle position, flywheel speed, and flywheel energy.

26. The method as recited in claim 24, wherein the slide energy and/or work determination step further includes the step of:

providing a measure of slide energy and/or work as an instantaneous value and/or a cumulative value relative to a press load condition and/or a no-load press condition.

27. The method as recited in claim 24, wherein the slide energy and/or work determination step further includes the step of:

providing a measure of slide kinetic energy.

28. The method as recited in claim 24, wherein the slide energy and/or work determination step further includes the step of:

providing a measure of load developed by said slide.

29. The method as recited in claim 28, wherein the load measurement providing step further includes the steps of:

causing the slide to engage a piston of a piston-cylinder combination; and determining force and/or pressure applied to the piston of said piston-cylinder combination.

30. The method as recited in claim 24, further includes the step of:

determining flywheel speed and/or flywheel energy in terms of an absolute value and/or change in value.

31. The method as recited in claim 30, further includes the step of:

comparing the determination of slide energy and/or work with the determination pertaining to flywheel speed and/or flywheel energy.

32. A method for use with a press machine, said press machine having a slide, a flywheel operatively connected to said slide, and a die location, said method comprising the steps of:

determining slide energy and/or slide work; and outputting at an output device the determination of slide energy and/or work.

33. The method as recited in claim 32, wherein the slide energy and/or work determination step further includes the step of:

determining slide kinetic energy and/or slide-related load.

34. The method as recited in claim 32, wherein the determination of slide energy and/or slide work being provided as a function of slide location.

35. The method as recited in claim 32, further includes the step of:

providing an indication of flywheel speed and/or flywheel energy.

36. The method as recited in claim 35, further includes the step of:

comparing the determination of slide energy and/or work with the indication of flywheel speed and/or flywheel energy.

37. The method as recited in claim 36, wherein the comparison being made on the basis of slide location.

38. A method for use with a press machine, said press machine having a slide, a flywheel operatively connected to said slide, and a die location, said method comprising the steps of:

determining slide location;

determining a value of slide energy and/or slide work; and providing a comparison between the value of slide energy and/or slide work and the determination of slide location.

39. The method as recited in claim 38, further includes the steps of:

determining flywheel speed and/or flywheel energy.

40. The method as recited in claim 39, further includes the step of:

comparing the determination of slide energy and/or slide work with the determination pertaining to flywheel speed and/or flywheel energy.

41. The method as recited in claim 39, further includes the step of:

providing the determination of flywheel speed and/or flywheel energy in reference to the slide location determination.

* * * * *